US010847864B2

(12) United States Patent
Yurt et al.

(10) Patent No.: US 10,847,864 B2
(45) Date of Patent: Nov. 24, 2020

(54) FOLDABLE ANTENNA SYSTEM

(71) Applicant: ASELSAN ELEKTRONIK SANAYI VE TICARET ANONIM SIRKETI, Ankara (TR)

(72) Inventors: Hunkar Kemal Yurt, Ankara (TR); Ekrem Firtinaoglu, Ankara (TR); Ismail Guler, Ankara (TR)

(73) Assignee: ASELSAN ELEKTRONIK SANAYI VE TICARET ANONIM SIRKETI, Ankara (TR)

( * ) Notice: Subject to any disclaimer, the term of this patent is extended or adjusted under 35 U.S.C. 154(b) by 0 days.

(21) Appl. No.: 16/490,934

(22) PCT Filed: Oct. 24, 2018

(86) PCT No.: PCT/TR2018/050619
§ 371 (c)(1),
(2) Date: Sep. 4, 2019

(87) PCT Pub. No.: WO2019/125339
PCT Pub. Date: Jun. 27, 2019

(65) Prior Publication Data

US 2020/0014088 A1 Jan. 9, 2020

(30) Foreign Application Priority Data

Dec. 22, 2017 (TR) ..... 2017/21292

(51) Int. Cl.
*H01Q 1/08* (2006.01)
*H01Q 3/06* (2006.01)
(Continued)

(52) U.S. Cl.
CPC ..... *H01Q 1/08* (2013.01); *H01Q 1/1235* (2013.01); *H01Q 3/06* (2013.01); *H01Q 21/28* (2013.01)

(58) Field of Classification Search
CPC ..... H01Q 1/08; H01Q 1/084; H01Q 3/00; H01Q 3/02; H01Q 3/06; H01Q 3/08;
(Continued)

(56) References Cited

U.S. PATENT DOCUMENTS 2,702,346 A * 2/1955 Evans ..... H01Q 1/428 343/766
3,587,104 A * 6/1971 Budrow ..... H01Q 1/1235 343/704
(Continued)

FOREIGN PATENT DOCUMENTS

CN 201877563 U 6/2011
CN 106379247 A 2/2017

*Primary Examiner* — Thai Pham
(74) *Attorney, Agent, or Firm* — Bayramoglu Law Offices LLC

(57) ABSTRACT

A foldable antenna system particularly suitable for use in a radar system includes a first antenna and a second antenna providing signaling; a body part; at least an actuator connected to the body part; a first connection element; a second connection element configured to connect the second antenna to the first antenna; a third connection element movably connected to the first antenna and a carriage part fixing the actuator to a surface. One end of the first connection element is movably connected to the body part distal from the actuator and a second end is connected to the first antenna.

3 Claims, 3 Drawing Sheets

(51) Int. Cl.
*H01Q 1/12* (2006.01)
*H01Q 21/28* (2006.01)

(58) Field of Classification Search
CPC ..... H01Q 21/28; H01Q 1/12; H01Q 1/1235; H01Q 1/32; H01Q 1/3233
See application file for complete search history.

(56) References Cited

U.S. PATENT DOCUMENTS

| | | | | |
|---|---|---|---|---|
| 7,183,989 | B2 * | 2/2007 | Tietjen | G01S 7/03 343/757 |
| 8,446,326 | B2 * | 5/2013 | Tietjen | H01Q 1/084 343/757 |
| 2004/0135735 | A1 | 7/2004 | Naym et al. | |
| 2007/0205338 | A1 * | 9/2007 | Sabatino | H01Q 1/081 248/125.7 |
| 2011/0234464 | A1 * | 9/2011 | Hall | H01Q 3/08 343/765 |

* cited by examiner

FOLDABLE ANTENNA SYSTEM

CROSS REFERENCE TO THE RELATED APPLICATIONS

This application is the national phase entry of International Application No. PCT/TR2018/050619, filed on Oct. 24, 2018, which is based upon and claims priority to Turkish Patent Application No. 2017/21292, filed on Dec. 22, 2017, the entire contents of which are incorporated herein by reference.

TECHNICAL FIELD

The invention is related to a foldable antenna system, comprising at least two antennas that are to be used in a radar system.

BACKGROUND

It is required to fold the radar systems that comprise a plurality of antennas during transportation in order ensure that they are compact and are in a durable position and to return them back to their open position (required operation status) following the active usage condition in order to provide efficient signaling. For this purpose, foldable mechanisms having a plurality of degree of freedom is developed for radar systems including a plurality of antennas and the mechanism is driven via an actuator in respect to the degree of freedom. On the other hand, it is required for radar systems to have a minimum degree of freedom for repeatability, accuracy and safety of the signaling, and it is more preferable to perform the required location amendments via mechanical mechanism equipment. In this regard, on behalf of improving the technical field, it is required to provide foldable radar systems that require a lesser degree of freedom in order to be folded into a compact and durable position.

In the known state of the art, foldable mechanisms comprising more than two degrees have been provided. However; when a foldable mechanism has several degrees of freedom, it causes negative effects on communication signals due to its negative impact on repeatability and accuracy of antenna locations, as a result this leads to false data and decrease in system efficiency. Additionally, in radar systems that have several actuators, if the actuators do not step in synchronously during the folding process, it is possible to encounter problems such as contraction and locking.

SUMMARY

The present invention aims to develop a foldable antenna system that is suitable to be used in radar systems that comprise a plurality of antennas. The above mentioned antenna system comprises at least a first antenna providing signal exchange and at least a second antenna; at least one body part; at least an actuator that is connected to said body part and said first antenna, comprising at least one moving part that carries out linear movement in a vertical axis within said body part; at least a first connection element which enables the movement achieved during the lifting up of the movable part of the first antenna into rotational motion around the direction that is vertical to surface normal of said first antenna, whose one end is movably connected to the distal end of said actuator of said body part and the other end is connected to the first antenna; at least a second connection element movably connected to said first antenna which provides the connection between said second antenna and said first antenna; at least a third connection element which enables to bring said second antenna to an inclined position in terms of the horizontal axis by transferring the rotational movement of said first antenna around a vertical direction to surface normal and at least one carriage part which enables to fix said actuator to a surface.

In the foldable antenna system of the present invention, an antenna system is developed which moves in one degree of freedom using less actuators, prevents contraction and locking problems by moving the mechanism group situated in both sides of antennas synchronously, enables to protect the physical and signal interaction effects of antennas when they are in the folded position and ensures that said antennas are resistant to external factors such as wind, which is compact, easy to carry and prevents signal failure during communication.

Aim of the Invention

The aim of the present invention is to develop a foldable antenna system.

Another aim of the present invention is to develop a foldable antenna system comprising at least two different antennas.

Another aim of the present invention is to develop a foldable antenna system having one degree of freedom.

Another aim of the present invention is to develop a foldable antenna system that is protected from environmental factors and is transportable by cargo planes and land platforms when they are in the closed position.

Another aim of the present invention is to develop a foldable antenna system providing an efficient signal exchange and protecting the required positions of antennas against environmental loads when they are in the open position.

BRIEF DESCRIPTION OF THE DRAWINGS

Embodiments of a foldable antenna system developed by the present invention is illustrated in the attached drawings, wherein.

Figure 1:
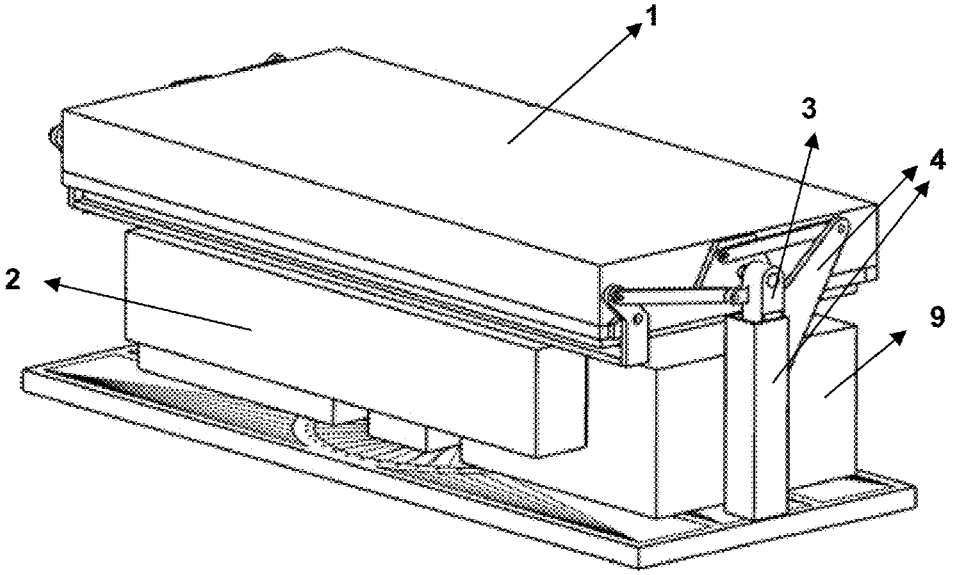
FIG. 1 is a perspective view of the developed foldable antenna system in the closed position.

The items in figures have each been numbered and their references have been provided below:

First antenna (1)
Second antenna (2)
Actuator (3)
Body part (4)
First connection element (5)
Second connection element (6)
Third connection element (7)
Carriage part (8)
Protective Housing (9)

DETAILED DESCRIPTION OF THE EMBODIMENTS

In order to bring radar systems having a plurality of antenna to a compact and durable position during carriage, it shall be foldable and when active usage position is required it shall regain its open position in order to perform efficient signaling and protect its position against environmental loads. For this reason, foldable mechanisms having a plurality of freedom degree is developed for the radar systems including a plurality of antennas and it is driven via a mechanism concerning its degree of freedom. However; when foldable mechanism has many degrees of freedom, it causes negative effects on communication signals due to its negative impact on repeatability and accuracy of antenna locations, as a result false data and decrease in systems efficiency occurs. For this reason with the present invention, it is provided a foldable antenna system providing radar system to be folded in a compact and safe position and having at least one degree of freedom.

Figure 2:
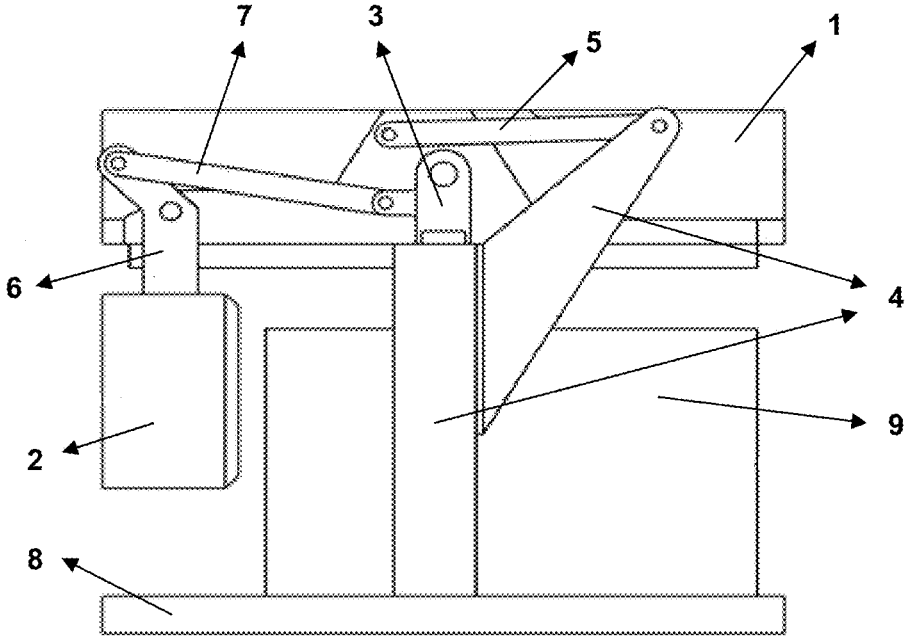
FIG. 2 is a side view of the developed foldable antenna system in the closed position.
Figure 3:
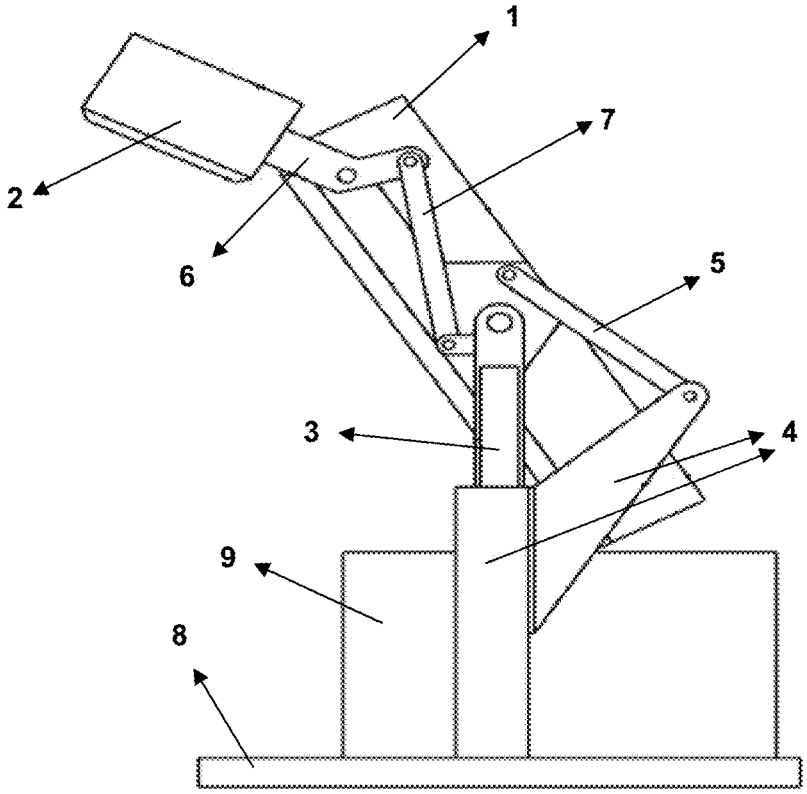
FIG. 3 is a side view of the movable state of the developed foldable antenna system.
Figure 4:
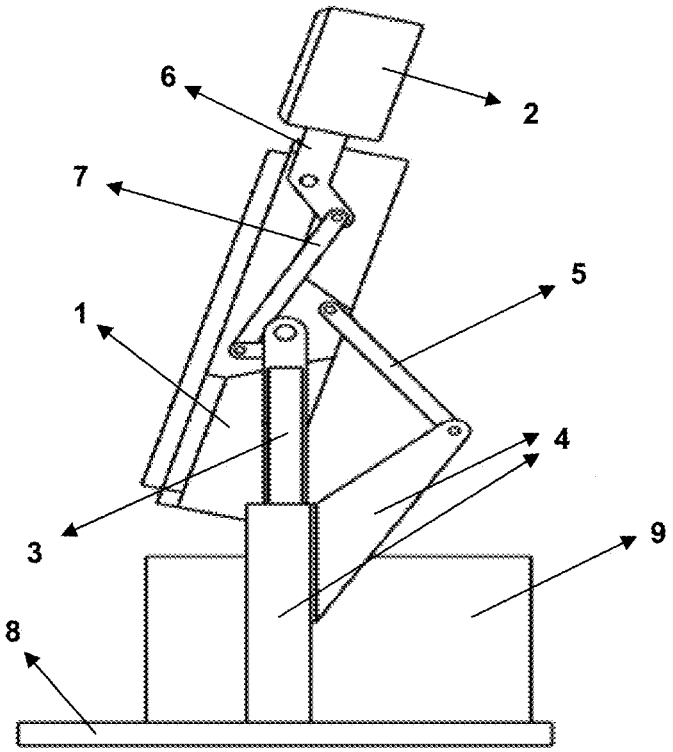
FIG. 4 is a side view of the developed foldable antenna system in the open position.
Figure 5:
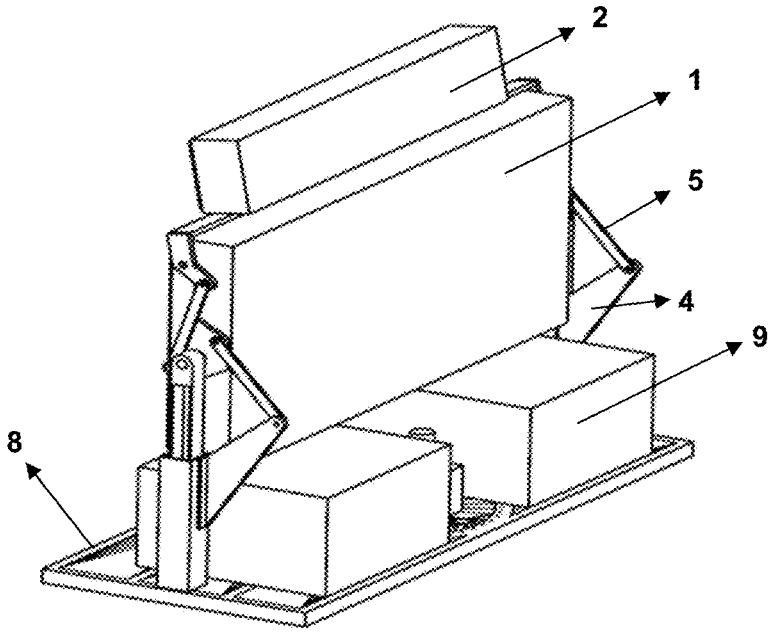
FIG. 5 is a perspective view of the developed foldable antenna system from the rear.

Foldable antenna system illustrated in FIGS. 1-5 which is described by the present invention comprises; at least a first antenna (1) and at least a second antenna (2); at least a body part (4); at least a actuator (3) connected to said body part (4) and (preferably from the middle points of two sides of said first antenna) said first antenna (1), having at least one movable part ascending and descending in a vertical axis (Y) within said body part; at least one first connection element (5) transforming the movement of said movable part during ascending into the rotational movement of said first antenna (1) around a direction vertical (In FIG. 2 page layout normal) to surface normal for bringing surface normal of said first antenna (1) to an inclined position in respect to the horizontal axis (X) (preferably 105 degrees), wherein one end is movably connected to said body part (4) distal from said actuator and the other end is connected to said first antenna (1); at least a second connection element (6) which enables the connection of the second antenna (2) to said first antenna (1) which is movably connected to said first antenna (1); at least a third connection element (7) enabling said second antenna (1) in respect to horizontal axis (X) (preferably 105 degrees) to be brought to an inclined position by transferring the rotational movement of said first antenna (1) that rotates around a direction vertical to surface normal (In FIG. 2—page layout normal) to the second connection element (6) and at least a carriage part (8) enabling said body part (4) to be fixed to a surface.

In an exemplary embodiment of this invention said foldable antenna system is in a closed position which is located between said first antenna (1) and said carriage part (8) wherein the first antenna (1) is positioned parallel to the horizontal axis (X); wherein said second antenna (2) is located in a position parallel to the vertical axis (2) and within the surface area borders of said first antenna (1). Upon activating said actuator (3) said movable part, rises in a vertical axis (Y) such that it shall move away from said body part (4); during the rising of said movable part in a vertical axis (Y), the first connection element (5) that is connected to said body part (4) establishes force such that it provides resistance to the first antenna (1) against the motion, and enables the rotation around the vertical direction (In FIG. 2—page layout normal) to the surface normal of the first antenna (1), preferably rotation of 105 degrees, such that the first antenna (1) shall form an angle to the horizontal axis (X).

During the rotational movement of said first antenna (1), said first antenna (1) is brought to a position of the same angular direction by providing 195 degrees rotation of said second antenna in respect to horizontal axis (X), preferably 90 degrees in respect to the first antenna (1), around the direction vertical (In FIG. 2—page layout normal) to the surface normal of said second antenna (2), together with the force exerted by said third connection element (7) connected to non-connected end of said second antenna (2) of said second connection element (6) and said movable part to non-connected end of said second antenna (2) of said second connection element (6). Thus, the foldable antenna system is brought to an open position, wherein said first antenna (1) and second antenna (2) is situated in the same angular direction and by forming 75 degrees angle with preferably horizontal axis. Upon reactivating said actuator (3), said movable part descends in vertical axis (y) such that it becomes close to said Carriage part (8) and it ensures to bring foldable antenna system to said open position.

In a preferred embodiment of this invention said foldable antenna system comprises at least a housing (9) located between said first antenna (1) and said carriage part, protects said equipment from physical and signaling impacts by surrounding around electronic components such as electronic circuit card, cables used for the operation of the system.

In another preferred embodiment of this invention, when the foldable antenna system is in closed position and during shift between positions, contact of said first antenna (1) and said second antenna (2) with said housing (9) is prevented.

In another preferred embodiment of this invention, synchronous movement of said first antenna (1) and said second antenna (2) is provided by using function synthesis method.

In an alternative preferred embodiment of this invention, the foldable antenna system provides easy access to electronic components within said first antenna (1) and said second antenna (2).

In an alternative preferred embodiment of this invention, when the foldable antenna system is in closed position, signal receiving surfaces are protected against physical effects by positioning signal receiving surfaces of said first antenna (1) and said second antenna (2) in a manner that they face the center of the system.

In an alternative preferred embodiment of this invention, when the foldable antenna system is in open position, in order to establish a high resistance to wing force, said body part (4) and said first connection element (5) are made of physically durable material and designed for withstanding to loads.

In another preferred embodiment of this invention, in order to facilitate maintenance of the foldable antenna system, said first antenna (1) and said second antenna (2) are fixed in the direction of the vertical axis (Y).

In another preferred embodiment of this invention, in the foldable antenna system, one for each two connection element (6) on two opposing sides of second antenna (2) is situated and comprises a connecting piece functions as a bridge between said connection elements. Said second antenna (2) can be fixed on said connecting piece.

In the foldable antenna system developed with this invention, an antenna system is provided to be movable in one degree of freedom using very few actuator, to prevent problems as contraction and interlocking by moving mechanism group situated at both sides of antennas synchronously, to protect antennas in closed position against physical and signaling effects and in open position against environmental effects such as wind, to establish an antenna system that is durable, compact, easy to transport and preventing signal failures during communication.

The invention claimed is:

1. A foldable antenna system, comprising:

a first antenna and a second antenna, wherein the second antenna is configured to provide a signal exchange;

a body part;

an actuator connected to the body part and the first antenna, wherein the actuator linearly moves in a direction of a vertical Y-axis within the body part and comprises at least one movable part;

a first connection element configured to transforming a movement of the movable part during ascending into a rotational movement of the first antenna around a direction vertical to a surface normal of the first antenna, wherein the surface normal of the first antenna is brought to a first inclined position in respect to a horizontal X-axis, a first end of the first connection element is movably connected to the body part distal from the actuator and a second end is connected to the first antenna;

a second connection element movably connected to the first antenna, wherein the second connection element is configured to connect the second antenna to the first antenna;

a third connection element configured to bring the second antenna to a second inclined position in respect to the horizontal X-axis by transferring the rotational movement of the first antenna around the direction vertical to the surface normal to the second connection element and a carriage part fixing the body part to a surface.

2. The foldable antenna system according to claim 1, further comprising a housing located between the first antenna and the carriage part.

3. The foldable antenna system according to claim 1, wherein a complete access to a back surface of the first antenna and the second antenna is allowed when the first antenna pair and the second antenna is in a closed position.

* * * * *